US006113406A

United States Patent [19]

Lin et al.

[11] Patent Number: 6,113,406

[45] Date of Patent: Sep. 5, 2000

[54] ELECTRICAL INTERCONNECT USING LOW MELTING POINT LIQUID METALS

[75] Inventors: Thomas F. Lin, State College; James B. Gilbert, II, Barto, both of Pa.

[73] Assignee: The Penn State Research Foundation, University Park, Pa.

[21] Appl. No.: 09/169,098

[22] Filed: Oct. 9, 1998

Related U.S. Application Data

[60] Provisional application No. 60/061,591, Oct. 10, 1997.

[51] Int. Cl.[7] ..... H01R 3/08

[52] U.S. Cl. ..... 439/179

[58] Field of Search ..... 439/178, 179, 439/844, 874, 876

[56] References Cited

U.S. PATENT DOCUMENTS 4,289,369 9/1981 Taketoshi ..... 439/179

*Primary Examiner*—Neil Abrams
*Assistant Examiner*—Eugene G. Byrd
*Attorney, Agent, or Firm*—Thomas J. Monahan

[57] ABSTRACT

An electrical interconnect incorporating the invention includes a first conductive electrode having a male connector part; a second electrode having a female connector part closely coupled to the male connector part so as to create opposed surface regions of area A for electrical conduction therebetween; and a fusible alloy layer of maximum thickness t, positioned within the area A and between the male electrical part and the female electrical part, the fusible alloy having a resistivity that is greater than a resistivity of either the first electrode or the second electrode. A ratio of t to A assures that the resistance of the fusible alloy layer is smaller than the resistance of either the first electrode or the second electrode.

6 Claims, 3 Drawing Sheets

ELECTRICAL INTERCONNECT USING LOW MELTING POINT LIQUID METALS

This Application claims priority from U.S. provisional application Ser. No. 60/061,591, filed Oct. 10, 1997.

FIELD OF THE INVENTION

This invention relates to improved electrical interconnections which make use of low melting point fusible alloys and, more particularly, to a flexible interconnection technique using a low melting point alloy which manifests a very low resistance.

BACKGROUND OF THE INVENTION

In the design of reactor core and fuel assemblies for most types of nuclear power reactors, it is important to conduct tests to characterize the thermal-hydraulic condition at which the departure from nucleate boiling (DNB) phenomenon occurs in the fuel assembly. The tests require identification of both lateral and longitudinal locations of the DNB events in a fuel assembly. The DNB phenomenon, sometimes referred to as Boiling Crisis, limits the operation margins of a particular reactor fuel design and must be well studied.

For decades, reactor component designers have used electrically heated rods as simulated nuclear fuel. The coolant for the simulated fuel bundles is water and large amounts of electricity are consumed. Other low boiling point refrigerants such as freon may be used as the simulated coolant to minimize the electrical consumption, while retaining the basic physical phenomenon. Each electrically heated rod consists of a thin wall tube of high resistivity metal, such as inconel or monel, as the heated section, an unheated upstream section, and an unheated downstream section for flow development. The unheated sections are made of a low resistivity metal, such as nickel. The rod diameter and inter-rod spacing are set to be the same as those in an actual fuel rod assembly.

In order to achieve a realistic thermal-hydraulic condition in the reactor fuel rod assembly, electrically heated rods are arranged into a configuration such as a 3×3, 4×4, 5×5, 6×6, 7×7 square, or other hexagonal bundles. A 5×5 square bundle requires a total of 25 rods. All 25 rods are commonly bused (or electrically tied together) at two electrodes, a cathode on one end and an anode on the other, to allow electric current to pass through the rod bundle. In addition to DNB studies, electrically heated rod bundles may also be used to investigate other thermal-hydraulic phenomena of a reactor core, such as multiphase instability and post-accident reflood heat transfer.

Due to longitudinal thermal expansion and potential buckling, the individual heater rods cannot be rigidly anchored to both electrodes at the same time. Normally, one end of all heater rods may be rigidly tied to a common electrode which is made of a highly conductive metal, such as nickel. The opposite ends of all rods are left free to enable expanding or sliding. As a consequence, the free expanding ends of the heater rods need to be individually connected to a braided/flexible cable. All braided cables are then joined to the other common electrode.

This approach, as traditionally practiced in most DNB or other rod bundle heat transfer test facilities to counter the buckling problem, suffers from the tedious electrical connection (and disconnection) procedure and crowded cabling, particularly when the number of rods is large. In addition, the consistency and reliability of electrical contact in this type of connection may be compromised, which can result in undesirable arcing and local fusing.

Accordingly, it is an object of this invention to provide an improved flexible electrical connection that exhibits a low resistance.

It is another object of this invention to provide an improved flexible electrical interconection that is easily configured and exhibits a consistent low resistance interconnection.

SUMMARY OF THE INVENTION

An electrical interconnect incorporating the invention includes a first conductive electrode having a male connector part; a second electrode having a female connector part closely coupled to the male connector part so as to create opposed surface regions of area A for electrical conduction therebetween; and a fusible alloy layer of maximum thickness t, positioned within the area A and between the male electrical part and the female electrical part, the fusible alloy having a resistivity that is greater than a resistivity of either the first electrode or the second electrode. A ratio of t to A assures that the resistance of the fusible alloy layer is smaller than the resistance of either the first electrode or the second electrode.

DETAILED DESCRIPTION OF THE INVENTION

A preferred embodiment of the invention is to commonly bus the free expanding ends of heater rods using low-melting-point and safe fusible alloys which are liquid at relatively low temperatures, i.e., liquid metals. The basic approach is to use a solid block of highly conductive metal, such as copper or nickel, as the common electrode. Individual channels conforming to the rod pattern are machined into the block and the channels are filled with the fusible alloy. This arrangement allows the free, expanding ends of the rods to simultaneously be inserted into (or withdrawn from) the channels. While inserted, the fusible alloy remains between the rod and the channel wall and provides the necessary electrical continuity.

Figure 1:
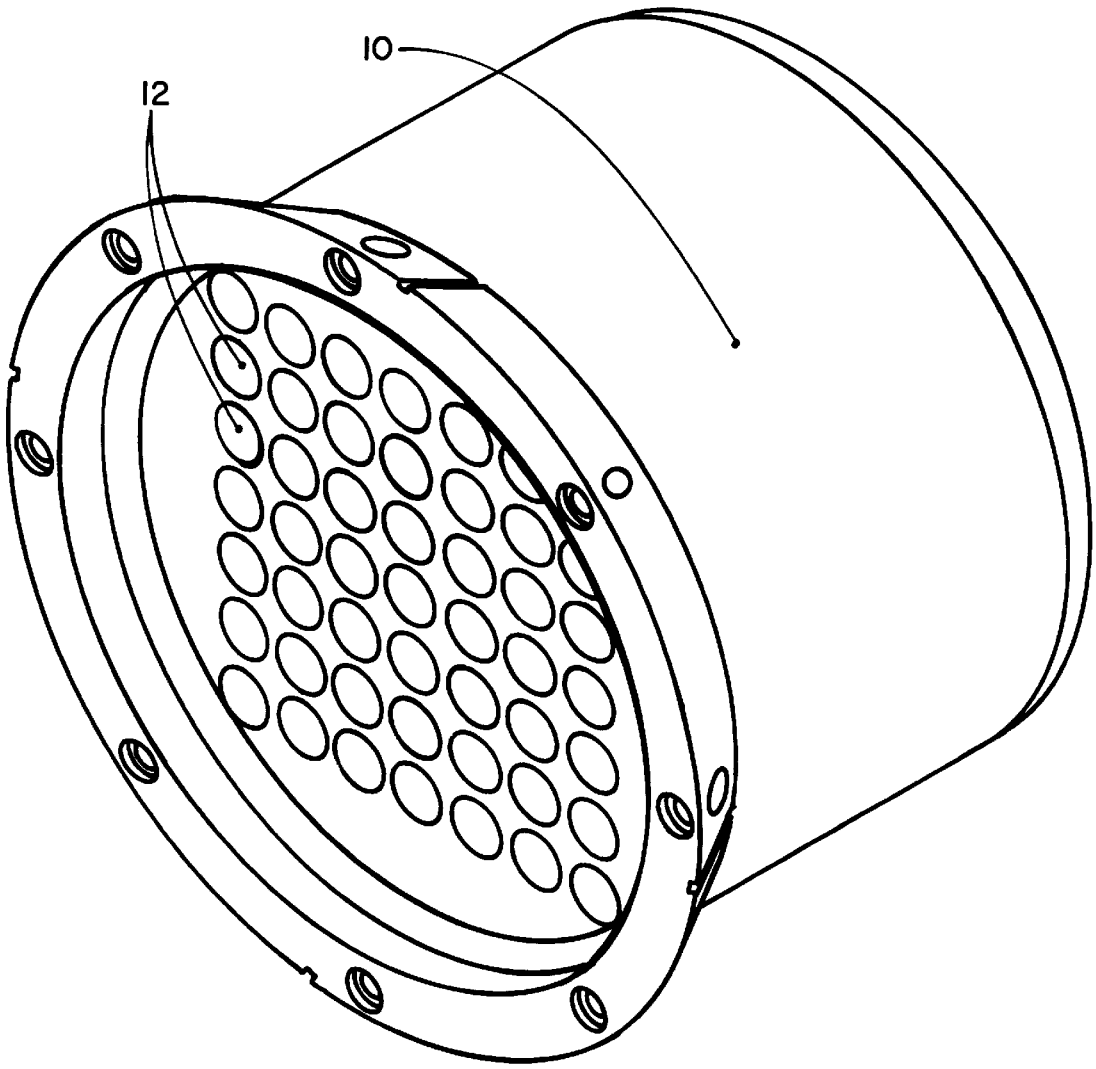
FIG. 1 is a perspective view of a connector block for providing a common bus for a plurality of conductive rods.

FIG. 1 depicts a device suitable for multi-rod common busing. This device was successfully built and tested with a 5×5 rod bundle. Shown in FIG. 1 is a copper block 10 that has been machined with channels 12 to conform with the rod pattern. Channels 12 are filled with a safe, low-melt metal fusible alloy to make contact with the heater rods. This block is fitted into the inside of an outer copper cup (not shown) which serves as an electrode and pressure boundary. Connecting passages and air bleeding holes are provided between the channels to maximize the filling of the low-melt material and to purge any air that may be trapped in the system.

While mercury is in the liquid state at room temperature and exhibits a high electric conductivity, it is toxic and inconvenient to work with. Although alkali metals or alloys exhibit low melting points, they are very combustable, chemically unstable, and pose potential human hazards. However, certain low-melting-point and safe liquid metals, commonly known as "fusible alloys", are solids at room temperature and are easily melted at a moderate temperature. Their melting points are typically from 100° F. to 500° F., although those with lower melting points (between 100° F. and 200° F.) have been found to be most useful for application to multi-lead common busing. Their traditional applications are in injection molding and casting, and to Applicants' knowledge, they have not been suggested for the electrical interconnection applications described herein.

The fusible alloys include, principally, the following five metal constituents, but with a large variation of mix ratios among them: bismuth, lead, tin, cadmium, and indium. Other trace materials in very small quantities may also be added. For example, a "Cerrosafe" metal manufactured by Cerro Metal products has been used in our application. Cerrosafe includes the following metal constituents: Bi-42.5%; Pb-37.7%; Sn-11.3%; and Cd-8.5%. It is a safe metal with a melting point of approximately 165F. The liquid state of such a metal can be easily maintained by a heater element attached to the electrode block. See: *Cerro Alloys Application Data*, published by Cerro Metal Products Co., Bellefonte, Pa. (undated).

Although the electrical conductivity of such a metal is only 4.27% of that of copper, its high current carrying capability can be achieved by: (1) maintaining a sufficient insertion depth of the free expanding rod to the liquid metal channel; and (2) maintaining a minimized gap distance between the inserted rod and the wall of the channel. This may be illustrated by comparing the resistance of the rod, which is made of highly conductive metals such as nickel, to that of the liquid metal around the inserted portion of the rod.

Figure 2:
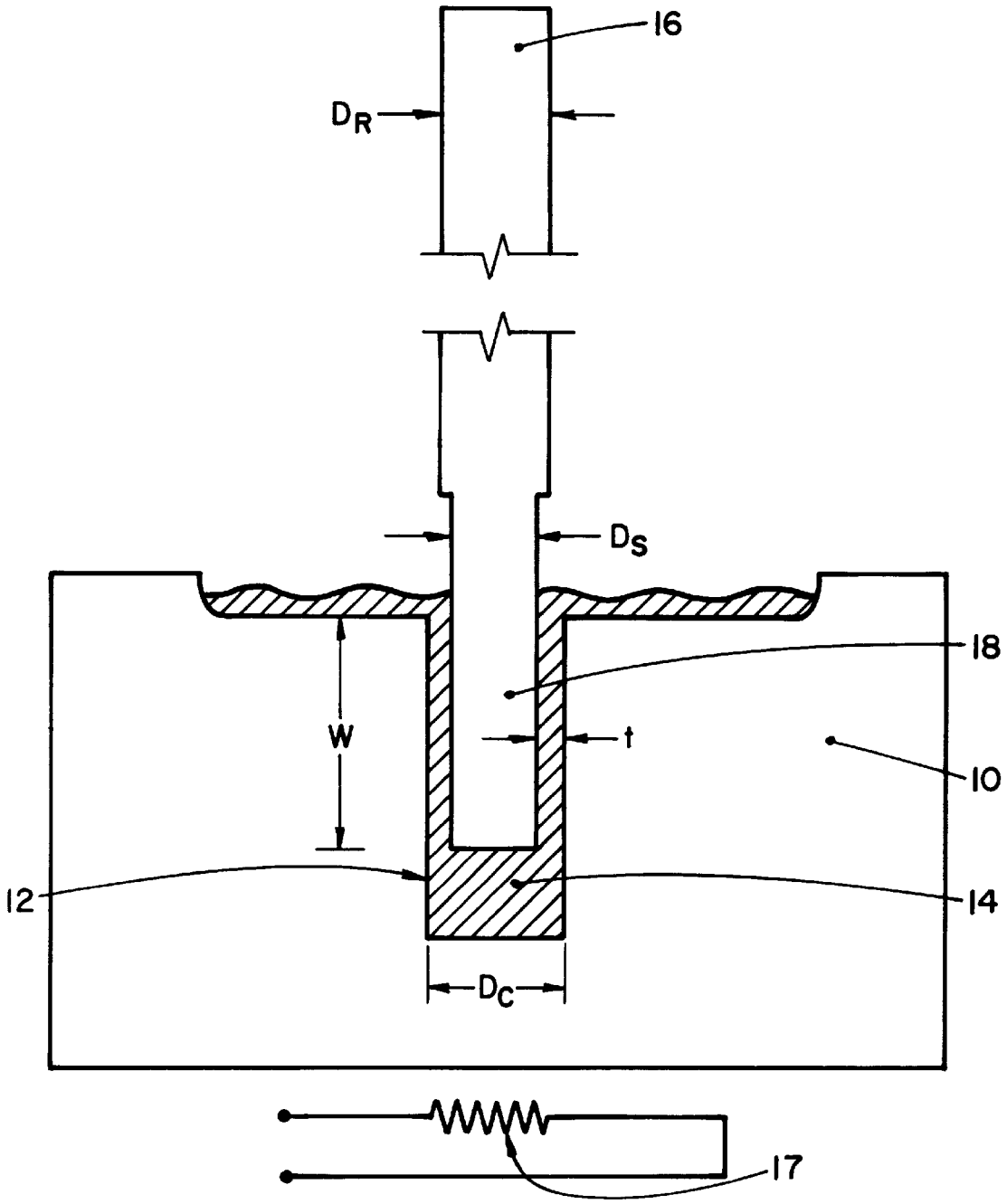
FIG. 2. is a sectional view illustrating the use of a fusible alloy as a low resistance interface for a pair of current carrying electrodes, i.e., a male electrode and a female electrode.

FIG. 2 is illustrative of a flexible connection made in accord with the invention. Conductive block 10 is shown in section, illustrating a single channel 12 positioned therein. Channel 12 includes fusible alloy 14. A conductive rod 16 includes a reduced diameter segment 18 which is dimensioned to fit within channel 12 in such a manner as to leave a layer of fusible alloy 14 between itself and the inner walls of channel 12. While the current flow and resistance losses through fusible alloy will generally be sufficient to maintain it in a liquid state, an auxiliary heater 17 may be used.

In a test configuration, comparable to that shown in FIG. 2, a single nickel rod having an 0.374" outer diameter (Dr), 48.9 inches long, and a reduced-diameter segment 18 (0.341" outer diameter Ds), approximately 1.5" long (W), was inserted into channel 12 that had been filled with fusible alloy 14 in a liquid state. Channel 12 had an inner diameter of 0.404" (Dc).

The electrical resistivities of copper, nickel, and the fusible alloy at room temperature are:

$$\rho_{Cu}=1.71\times10^{-6}\ \Omega\cdot\text{cm},$$

$$\rho_{Ni}=9.5\times10^{-6}\ \Omega\cdot\text{cm},$$

$$\rho_{LM-\rho Cu}/0.0427=4.0\times10^{-5}\ \Omega\cdot\text{cm, respectively.}$$

Assuming the resistivities of the metals do not change significantly from room temperature to their normal operating temperatures (between 200° F. and 300° F.), the overall resistances of the nickel rod and the fusible alloy are:

$$R_{Ni}=\rho_{Ni}\ L/(\tfrac{1}{4}\pi D^2)=6.23\times10^{-4}\ \Omega \text{ and}$$

$$R_{LM}=\rho_{LM}\ t/(\pi DW)=2.86\times10^{-7}\ \Omega\text{. respectively.}$$

Note that the resistance of the fusible alloy is directly dependent on the ratio of t to an area "A" of electrical "contact" (i.e., $\pi DW$). Thus, so long as $\pi Dw$ is maintained large with respect to t, the ultimate resistance of the fusible alloy interconnect can be maintained, preferably, much less than the resistance of the nickel rod and certainly no greater than the resistance of the nickel rod. As can be seen from the above calculation, the resistance of the fusible alloy interconnect 14 is negligibly small compared to that of nickel rod 16. Thus, this type of low-melting-point and safe liquid metal is an effective current carrying medium, while also providing a liquid cushion for nickel rod 16 to freely expand.

For multi-rod common busing, this invention is particularly attractive because the engagement and disengagement between all rods and electrode block 10 become a simple one-step procedure. After the disengagement, some solidified metal residuals may be attached to the ends of the heater rods. However, they are not sticky and can be easily removed. In all tests, the current carrying capability of the low-melting-point fusible alloy and convenient engagement of all rods were satisfactorily demonstrated.

Figure 3A:
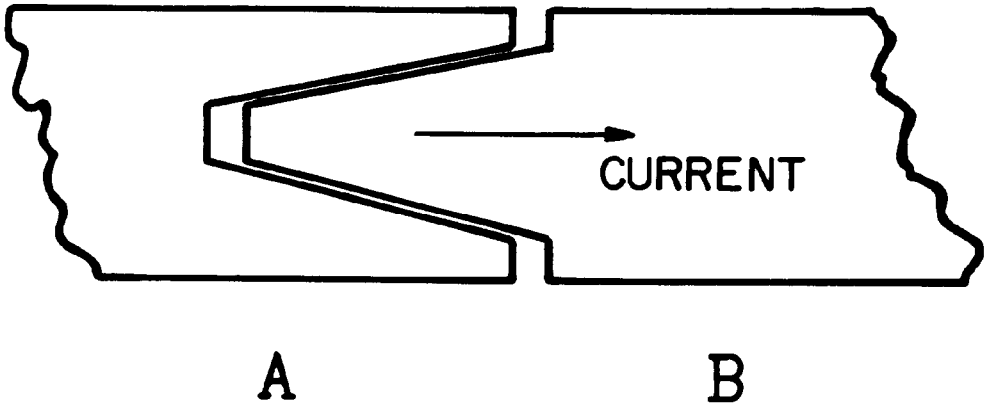
FIG. 3*a* illustrates a further configuration of an electrical interconnect without a fusible alloy interface.
Figure 3B:
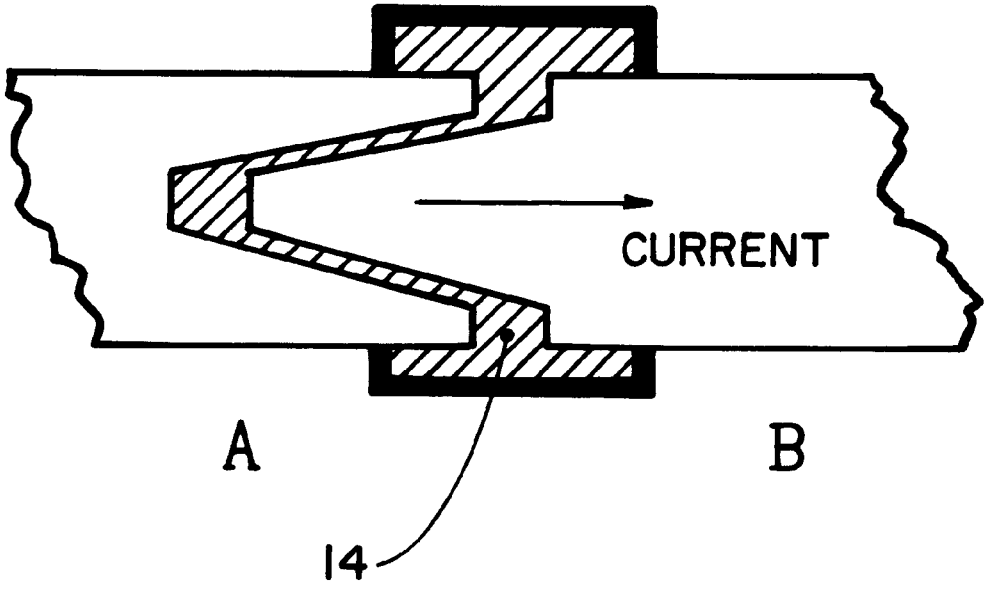
FIG. 3*b* illustrates the electrical interconnect configuration of FIG. 3*a* with a fusible alloy interface.

This invention can be applied to many industrial applications to provide "soft" current leads or contacts. Examples of such applications include, plasma processing, high-field magnets, and welding devices. FIG. 3*a* shows an un-cushioned direct metal-metal contact that is commonly used in such applications. The contact surfaces of mating parts A and B must be carefully machined and matched at the tapered section. Any slight mismatch of the mating surfaces enables arcing or localized fusing under very large currents. However, if fusible alloy 14 is introduced between the mating contacts and is tightly contained in a joint casing as shown in FIG. 3*b*, the machining tolerances of the direct contact surfaces may be greatly relaxed since the thin layer of fusible alloy provides both the necessary conducting path and the mechanical cushion.

Because the fusible alloy possesses a higher electric resistivity than the contact metal, it will naturally melt under Joulean dissipation as soon as a large current is applied through the device. This is desirable since the liquid state of the fusible alloy protects the mechanical integrity of the system. Furthermore, many fusible alloys exhibit interesting characteristics. For instance, their densities in the molten state are actually higher than when in the solid state. This means that they "shrink" when traversing from the solid state to the liquid state as they are heated to an elevated temperature. This is desirable since, as shown in FIG. 3(*b*), the joint casing which tightly contains the alloy will not experience any pressure increase (or risk rupture) when the fusible alloy is heated and undergoes a phase transformation from solid to liquid.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical interconnect comprising:

a first conductive electrode having a male connector part;

a second electrode having a female connector part coupled to said male connector part so as to create opposed surface regions therebetween, said opposed surface regions having areas A through which electrical conduction occurs to an opposite one of said opposed surfaces, said male connector part and female connector part separated by a distance t therebetween;

a fusible alloy layer positioned between said areas A and within said separation t between said male electrical part and said female electrical part, said fusible alloy having a resistivity that is greater than a resistivity of either said first electrode or said second electrode, a ratio of t to A assuring that a resistance of said fusible alloy layer is no greater than either a resistance of said first electrode or said second electrode, and wherein said fusible alloy layer includes at least bismuth and lead.

2. The electrical interconnect as recited in claim 1, wherein said fusible alloy layer exhibits a liquid state at operating temperatures of said interconnect.

3. The electrical interconnect as recited in claim 1, wherein said fusible alloy layer further includes tin and cadmium.

4. The electrical interconnect as recited in claim 1, wherein said fusible alloy layer includes the following elements in the following approximate percentages: bismuth-42,5%, lead-37.7%, tin-11.3% and cadmium-8.5%.

5. The electrical interconnect as recited in claim 1, wherein said electrical interconnect further includes means for maintaining said fusible alloy in a liquid state.

6. The electrical interconnect as recited in claim 1, wherein said resistance of said fusible alloy layer is substantially less than either a resistance of said first electrode or said second electrode.

* * * * *